US008251214B2

(12) United States Patent
Wade

(10) Patent No.: US 8,251,214 B2
(45) Date of Patent: Aug. 28, 2012

(54) METHOD FOR PROVIDING BACKGROUND GRAPHICS ON BLISTER CARD

(75) Inventor: Michael P Wade, Chesterfield, VA (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

(21) Appl. No.: 12/738,249

(22) PCT Filed: Oct. 24, 2008

(86) PCT No.: PCT/US2008/081068

§ 371 (c)(1),
(2), (4) Date: Apr. 15, 2010

(87) PCT Pub. No.: WO2009/055646

PCT Pub. Date: Apr. 30, 2009

(65) Prior Publication Data

US 2010/0206755 A1 Aug. 19, 2010

Related U.S. Application Data

(60) Provisional application No. 60/982,259, filed on Oct. 24, 2007.

(51) Int. Cl.
*B65D 73/00* (2006.01)
*B65D 85/00* (2006.01)

(52) U.S. Cl. ..... 206/462; 206/459.5; 206/461

(58) Field of Classification Search ..... 206/461, 206/462, 467, 470, 471, 459.5, 463; 53/397, 53/467, 476

See application file for complete search history.

(56) References Cited

U.S. PATENT DOCUMENTS

| | | | | |
|---|---|---|---|---|
| 3,178,019 | A | 4/1965 | Fetzek | |
| 3,279,596 | A * | 10/1966 | Prym et al. | 206/469 |
| 3,314,535 | A * | 4/1967 | Jarecki | 206/489 |
| 4,091,927 | A * | 5/1978 | Lunsford | 206/459.5 |
| 4,261,462 | A * | 4/1981 | Wysocki | 206/463 |
| 4,824,143 | A * | 4/1989 | Grainger | 283/56 |
| 6,059,112 | A * | 5/2000 | Dykstra et al. | 206/438 |
| 6,607,078 | B2 * | 8/2003 | Pedroli et al. | 206/462 |
| 6,676,584 | B2 * | 1/2004 | Tachikawa et al. | 493/70 |
| 7,051,876 | B2 * | 5/2006 | Grosskopf | 206/462 |
| 7,614,498 | B2 * | 11/2009 | O'Keefe | 206/459.5 |
| 2002/0148751 | A1 | 10/2002 | Pedroli et al. | |
| 2002/0162764 | A1 * | 11/2002 | Sherline et al. | 206/461 |
| 2006/0151350 | A1 * | 7/2006 | Tilton | 206/461 |
| 2007/0051652 | A1 | 3/2007 | Tilton | |
| 2007/0125679 | A1 * | 6/2007 | Smith | 206/462 |

FOREIGN PATENT DOCUMENTS

GB 810664 3/1959

OTHER PUBLICATIONS

International Search Report for PCT/US2008/018068, published Feb. 6, 2009.

* cited by examiner

*Primary Examiner* — Steven A. Reynolds
(74) *Attorney, Agent, or Firm* — MWV Intellectual Property Group

(57) ABSTRACT

A blister card includes graphics printed on a substrate surface, which is then cut to produce an opening through which a blister may be received. The cut-out portion of the substrate is transferred in proper register to a position behind the blister so as to provide a continuous graphic image on the package. A method is also described for providing background graphics on a blister card in the region behind the blister.

13 Claims, 5 Drawing Sheets

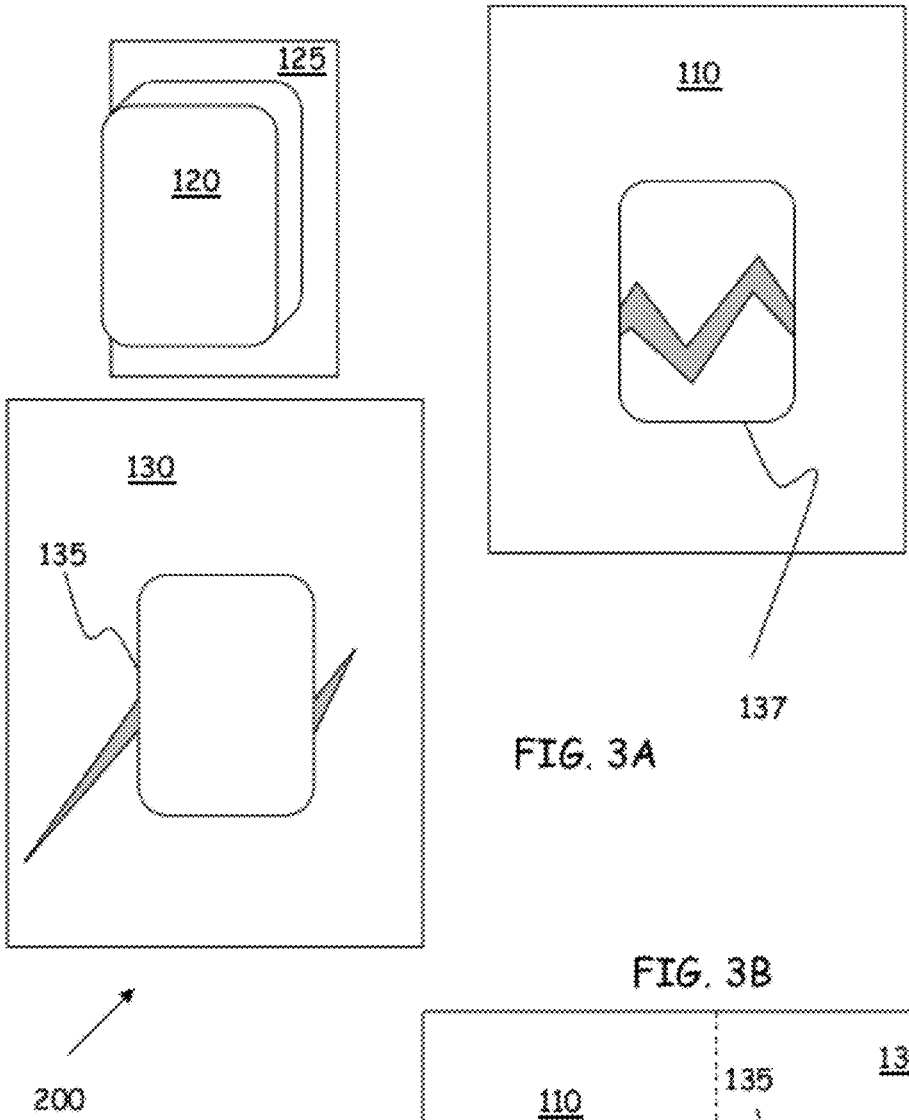
FIG. 3A
FIG. 3B
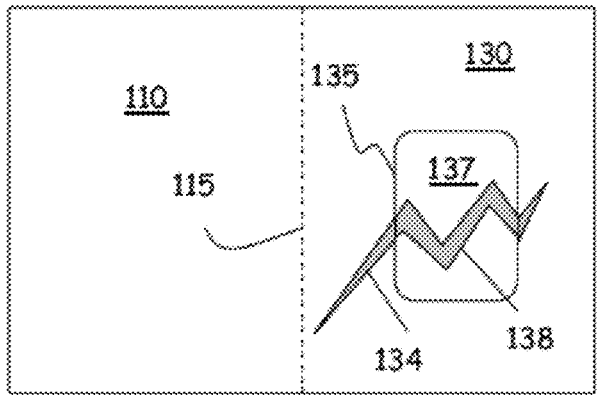

METHOD FOR PROVIDING BACKGROUND GRAPHICS ON BLISTER CARD

REFERENCE TO RELATED APPLICATIONS

This application claims the benefit of U.S. Provisional Application No. 60/982,259, entitled "Method for Providing Background Graphics in Blister Cavity Area on Tear Resistant Trap Seal Blister Cards" filed Oct. 24, 2007, and International Application Number PCT/US08/081068, entitled "Method for Providing Background Graphics on Blister Card," filed Oct. 24, 2008, and incorporates each herein by reference in their entirety.

BACKGROUND

Display cards are often used to show merchandise in a store environment. Display cards are typically made from sheet material such as paperboard where the card may generally have a lower thickness than corrugated packaging materials. A transparent portion such as a blister may be provided in order to improve product visibility; such packages are referred to in the art as a "blister package." For package strength and theft deterrence, the sheet material may be reinforced, for example made tear-resistant or tear-proof.

In one type of tear resistant structure, the front and back layers of paperboard may comprise unbleached paperboard, with the first side having a clay coating for a printing surface, and the second side having tear resistant and heat sealable properties. For example, the second side may be treated first with an extruded tie layer, then a laminated tear resistant layer, then an extruded or otherwise applied heat sealable adhesive layer. Thus the first side may be a printable "white" side and the second side is a heat-sealable "brown" side. Examples of a heat sealable tear resistant material are disclosed in U.S. Pat. No. 7,208,209 which is hereby incorporated by reference in its entirety.

Often the blister may include a transparent bubble portion defining a volume in which the product is contained, and a peripheral flange portion that may be trapped between a front and rear layer of paperboard. In such a case, there is usually an aperture in the front layer of paperboard, to accommodate the bubble portion of the blister. Usually the front layer of paperboard may have graphics printed thereon, for example on the outer or "white" side of a tear resistant paperboard. Typically these graphics do not extend behind the bubble portion of the blister, since the associated front layer material has been removed in creating the aperture. Thus the "brown" or inner side of the paperboard back layer shows behind the blister. It is difficult to print high quality graphics on the heat seal coating.

SUMMARY

In one embodiment of the invention, a display card is provided with a good quality printed graphic portion located behind a blister.

In another embodiment of the invention, a display card made with a tear resistant substrate is provided with a printed graphic portion located behind a blister.

In another embodiment of the invention, a method is disclosed for making a display card having a printed graphic portion located behind a blister.

BRIEF DESCRIPTION OF THE DRAWINGS

FIG. 3A is a perspective view of a partially assembled blister package in accordance with the present invention, FIG. 3B is a plan view of a front panel and back panel formed of a single sheet of material.

DETAILED DESCRIPTION

End users many times want a multi-color and/or graphic background behind the product that is displayed in the blister area. Paperboard card stock laminated with a film (tear resistant) containing a heat seal coating layer used for trap seal blister card applications may complicate the ability to back print graphic areas that would serve as the background or show through area of the blister cavity.

Display card structures are disclosed with a printed background graphic behind a blister enclosure, wherein the printed background graphic maintains image continuity with at least a portion of the other package graphics. A method is disclosed for providing the printed background graphic through the same process steps already used for printing other parts of the package.

Figure 1:
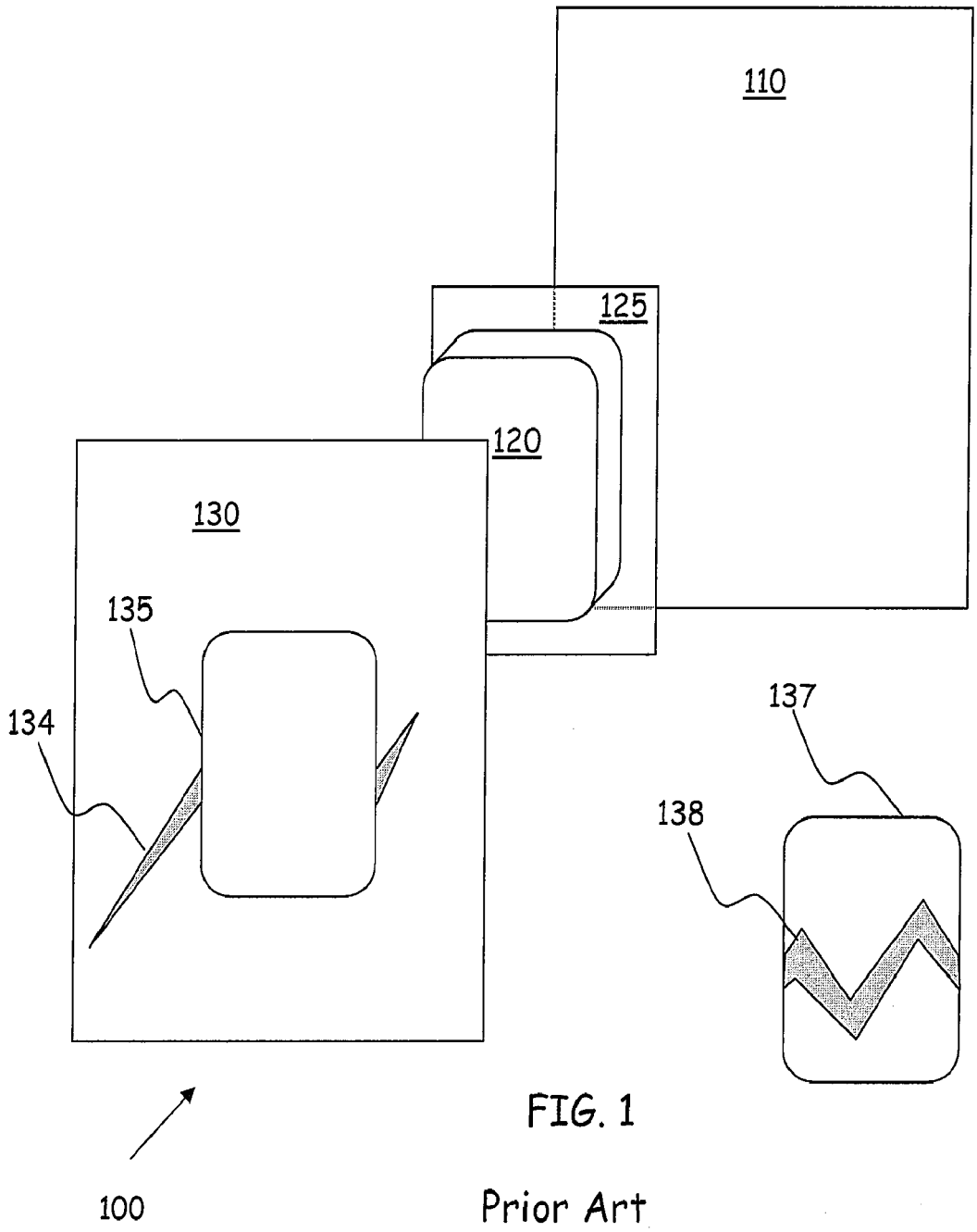
FIG. 1 Prior Art
FIG. 1 is a perspective view of an unassembled blister package of the prior art.

FIG. 1 is a perspective view of a display card 100 of the prior art, shown in an unassembled state. A back panel 110 is shown, for example a rectangular piece of paperboard. A blister 120 is provided, for example a formed piece of transparent plastic, forming a cavity in which to hold an object, and also having peripheral edges 125. A front panel 130 is shown, for example a rectangular piece of paperboard, also having a cutout area 135 through which the cavity portion of blister 120 may protrude. Cutout area 135 may be produced by a die-cutting operation, or by other suitable cutting operation such as laser cutting, etc.

Graphics 134 are typically printed on front panel 130, usually before cutout area 135 is removed. Before or after printing these graphics, front panel may be treated to provide tear resistance (or additional tear resistance), scuff resistance, water resistance, or other useful properties, for example by one or more special coatings.

If printing is done before removal of die-cut portion 137, then die-cut portion 137 may contain a graphics portion 138 that is complementary to the graphics 134 on the front panel 130. However, as a result of producing cutout area 135, a die-cut portion 137 is created which may typically be discarded, so that the area behind the blister may be left without graphics.

Figure 2:
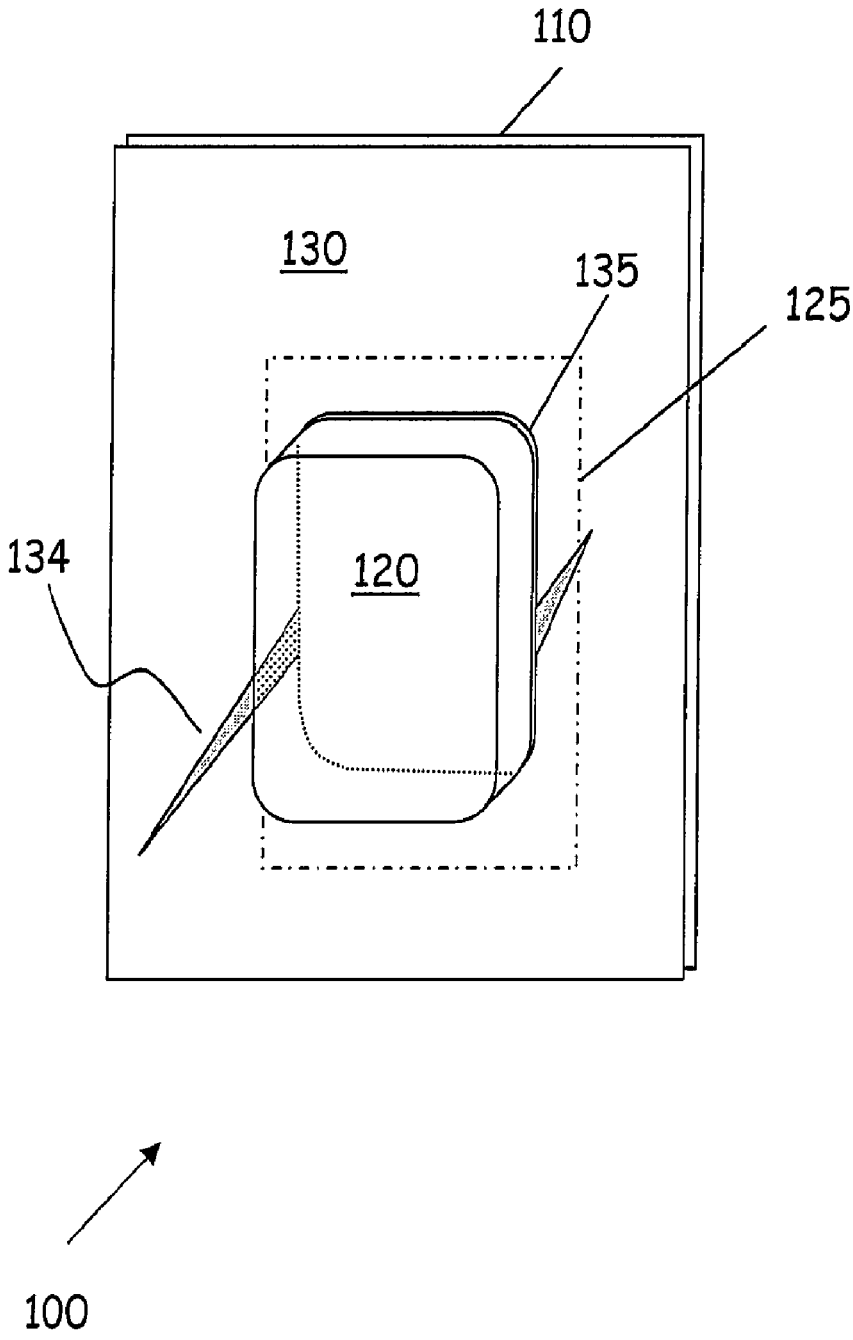
FIG. 2 Prior Art
FIG. 2 is a perspective view of the assembled blister card of FIG. 1.

FIG. 2 is a perspective view of the display card 100, shown in an assembled state. Typically this assembled state is achieved by placing an object in the blister 120, then sandwiching the blister 120 between the back panel 110 and front panel 130, with the periphery 125 of the blister captured between the two panels. The panels may be sealed together by any one of a variety of methods, for example by adhesive or heat sealing or by RF sealing. The back panel 110 and front panel 130 may be separate pieces, or they may be formed from one piece, joined at an edge.

In the display card 100 of FIG. 2, the die-cut portion is omitted. Therefore the graphics 134 on front panel 130 are discontinuous or incomplete.

FIG. 3A is a perspective view of a display card 200 in an embodiment of the current invention, shown in an unassembled state. A back panel 110 is shown, for example a rectangular piece of paperboard. A blister 120 is provided, for example a formed piece of transparent plastic, forming a cavity in which to hold an object, and also having peripheral edges 125. A front panel 130 is shown, for example a rectangular piece of paperboard, also having a cutout area 135 through which the cavity portion of blister 120 may protrude. Cutout area 135 may be produced by a die-cutting operation, or by other suitable cutting operation such as laser cutting, etc.

Graphics 134 are typically printed on front panel 130, usually before cutout area 135 is removed. Before or after printing these graphics, front panel may be treated to provide tear resistance (or additional tear resistance), scuff resistance, water resistance, or other useful properties, for example by one or more special coatings.

As a result of producing cutout area 135, a die-cut portion 137 results. Provided printing is done before removal of die-cut portion 137, then die-cut portion 137 may contain a graphics portion 138 that is complementary to or continuous with the graphics 134 on the front panel 130 and in proper registration therewith. This die-cut portion 137 is coupled to the back panel 110 as shown, in proper registration with the associated cutout area 135 in the front panel 130. The coupling may be done by various methods, for example adhesive, hot melt glue, heat seal, etc. One method to accomplish this is to provide the front and back panels together as a unitary piece, for example as shown in FIG. 3B, either in web or sheet form, and to print the clay-coated (outer) side of the web/sheet. The web or sheet may then be folded to bring the front and back panels into registration. Hot melt glue may be applied to one or both of the front and back panels, in the area of the die cut portion. Alternatively this area may be prepared for adhesion by applying heat by various methods such as hot air heating, RF heating, Ultrasonic heating, or the like. The die cut portion may then be pressed against the back panel in proper registration. The die cut portion may be held in place on the front panel by nicks (incomplete cuts), and may be punched or pressed from the front panel and into contact with the back panel. The die cut portion may be pressed against the back panel in proper registration by a heated platen. These methods of adhering the die cut portion to the back panel preferably leave the remainder of the front panel (other than the die cut area) unadhered to the back panel. For example, sheet metal fingers may be positioned between the front and back panels, and used to separate the non-adhered areas after the die cut portion is adhered to the back panel. Alternately, vacuum pickup devices, or other suitable devices used for handling sheet materials, may be used to separate the front and back panels.

Rather than providing the front and back panels in the form of a unitary web or sheet, they may be provided as separate sheets or as two webs, or a combination of sheets and web.

Figure 4:
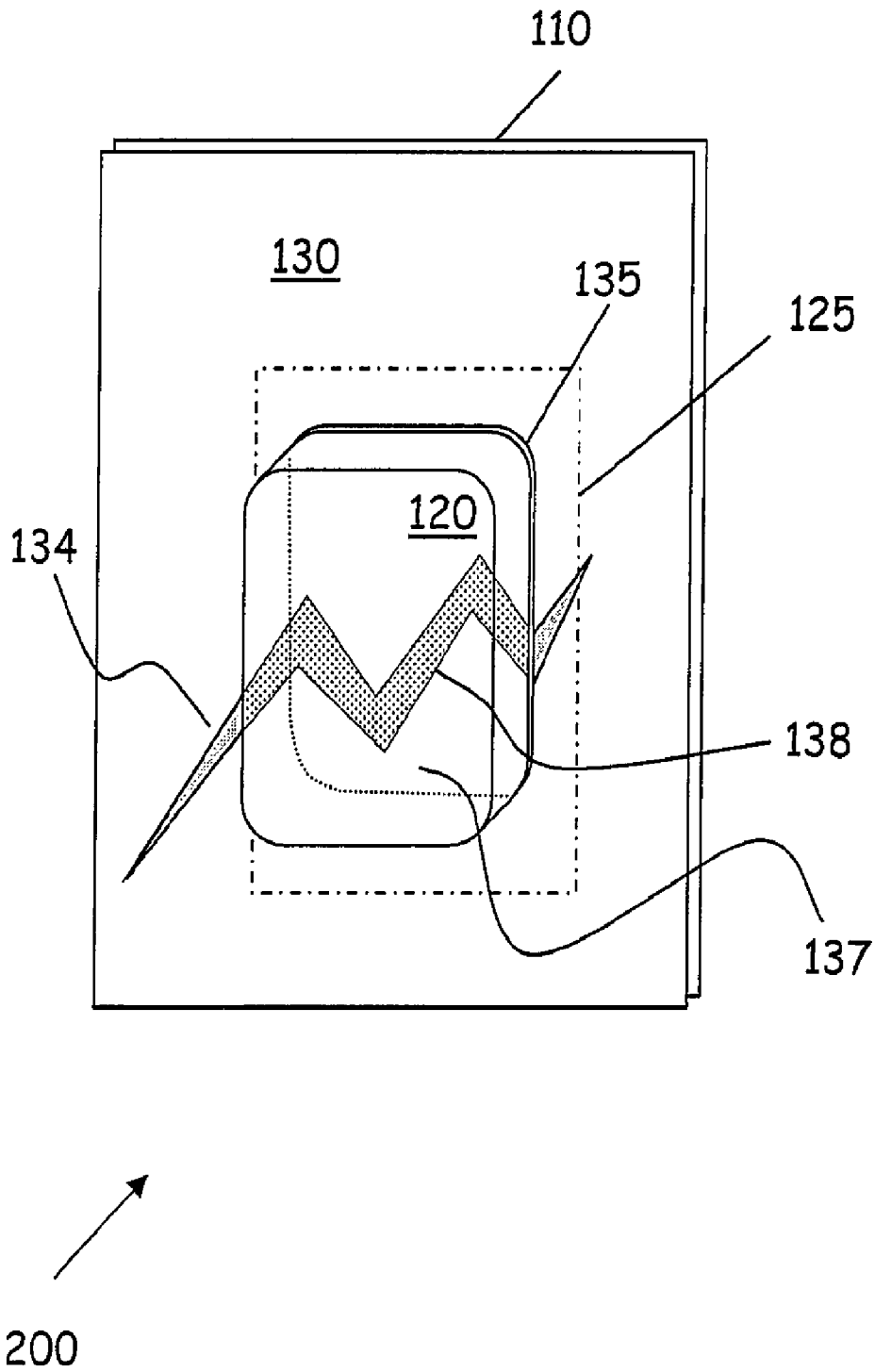
FIG. 4 is a perspective view of an assembled blister package in accordance with the present invention.

FIG. 4 is a perspective view of the display card 200, shown in an assembled state. Typically this assembled state is achieved by placing an object in the blister 120, then sandwiching the blister 120 between the back panel 110 and front panel 130, with the periphery 125 of the blister captured between the two panels. The die-cut portion 137 is thus located behind the blister 120, the graphic portion 138 of the die-cut portion 137 is in registration with the graphics 134 provided on front panel 130.

The panels may be sealed together by any one of a variety of methods, for example by adhesive or heat sealing or by RF sealing. The back panel 110 and front panel 130 may be separate pieces, or they may be formed from one piece, joined at an edge.

Figure 5:
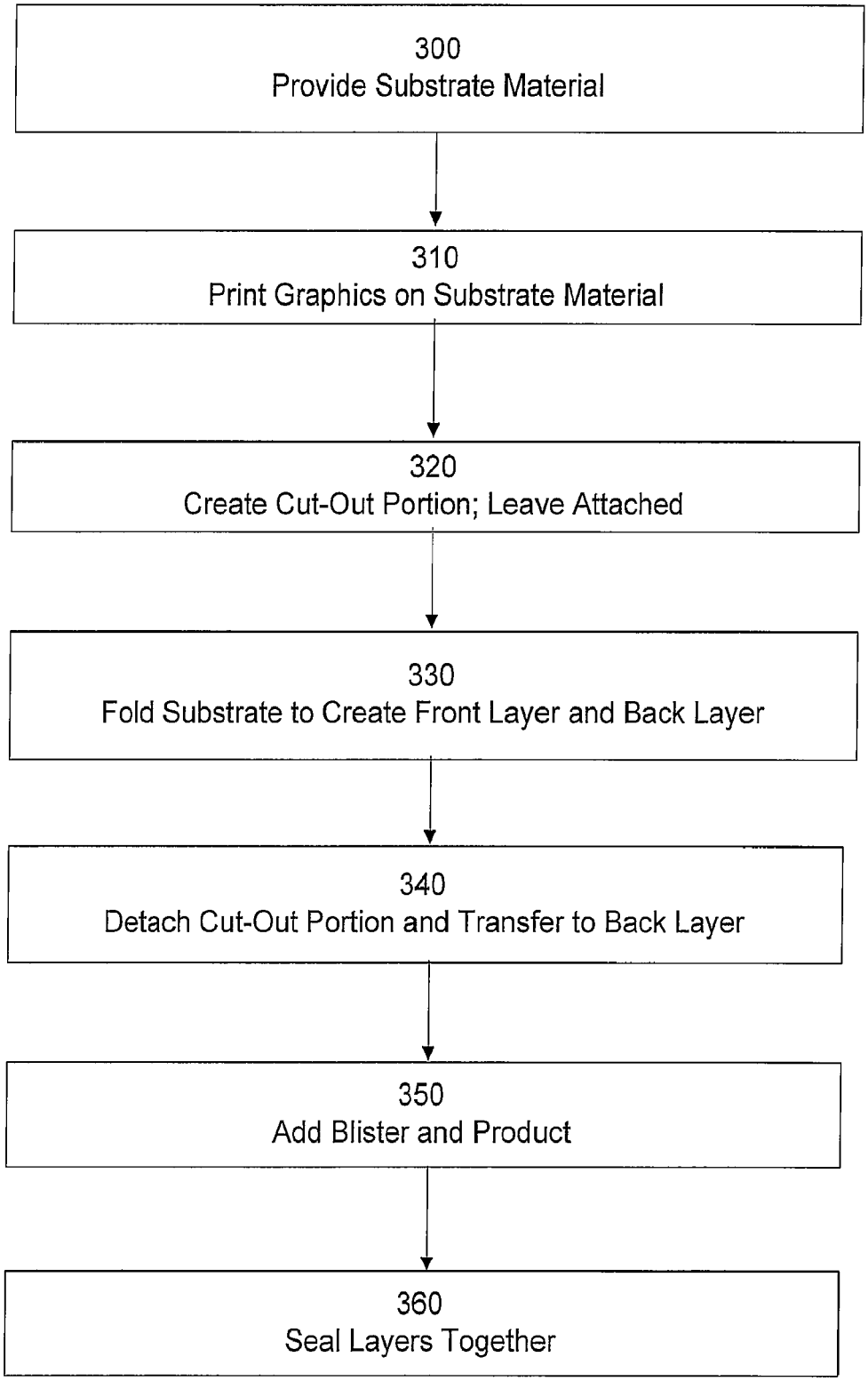
FIG. 5 is a flow chart showing an exemplary method for making a blister package in accordance with the present invention.

FIG. 5 is a flow chart describing an exemplary method for making the display card structure. In step 300, a substrate material is provided. This substrate may for example have a heat seal and/or laminated coating on one surface, and a surface suitable for printing on an opposite side. The substrate material could, for example, be a paperboard with suitable printing and tear resistant properties. In step 310, graphics are printed on the substrate material. Such graphics might include advertising, instructions, pricing, bar codes, etc. In step 320, a cut-out portion is created, for example by a die-cutting process. The cut-out portion, however, may stay attached to the remainder of the substrate. This can be achieved by providing a small number of uncut portions along the die-cut line.

In step 330, the substrate may be folded to create a front layer and a back layer separated by the fold, with the printed surfaces facing outward. This brings into proximity the unprinted (inner) surfaces of the front layer and back layer. In step 340, the die-cut portion may be detached from the front layer and transferred to the back layer, to which it may be attached. The die-cut portion is then attached to the back layer, in general registration with the opening left behind in the front layer. The attachment may be by one or more spots, or a general area, for example by an adhesive attachment.

Instead of folding the front layer and back layer together, the layers may be formed in a single sheet, then cut apart before bringing the layers back together. Alternately, the layers may be formed in separate sheets, then brought together. The die-cut portion of the front layer that will be behind the blister opening may be separated from the remainder of the front layer before or after attaching the die-cut portion to the back layer. In some cases it may be useful to keep the die-cut portion attached for a time to the front layer in order to more easily handle the die-cut portion. For example, if the die-cut portion is circular, it may be easier to handle and position the die-cut portion by keeping it attached for a time to the front layer (which for example may be larger and have a rectangular shape).

In step 350, a blister may be placed with its volume generally located through the opening in the front layer. Product may be placed within the volume. The front and back layers may then be brought together, trapping the flange of the blister and thereby holding it securely between the front and back layers. In step 360 the front and back layers may then be sealed together, for example by heat sealing, hot melt glue, adhesives, mechanical fastening, etc Sealing methods may include hot air, heated platen, RF sealing, ultrasonic sealing, microwave or gluing (cold or hot adhesives).

Following step 360, the die-cut portion with its graphics is located behind the blister, in registration with the remainder of the graphics on the front layer.

In addition to providing a high quality graphic background behind the blister, certain embodiments also provide additional strength and tear resistance to the area behind the blister, since this area now comprises material (originally) from the front panel as well as the rear panel.

Besides being used with tear-resistant substrate, or substrates that have been made tear-resistant by coating with appropriate materials, it is also contemplated that the invention may be practiced with substrates that are not tear resistant. For example, the concept applies to extrusion coatings such as heat seal coatings, that may or may not be tear resistant. The concept also applies to laminated substrates that again may be tear resistant or not tear resistant. The concept is advantageous, for example, with substrates having back side coatings that are difficult to print, and in cases where it is not desired to coat the backside, for example when only a small portion will be visible, such as the area behind a blister. A wide variety of substrate may be used, including but not limited to clay coated natural Kraft (CNK) and Solid Bleached Sulfate (SBS) sheet. The substrates may comprise extrusion heat seal and laminate materials.

Methods of making and using the display card structures in accordance with the invention should be readily apparent from the mere description as provided herein.

While exemplary embodiments of the invention have been described and illustrated, it should be apparent that many modifications to the embodiments and implementations of the invention can be made without departing from the spirit or scope of the invention.

It is to be understood therefore that the invention is not limited to the particular embodiments disclosed (or apparent from the disclosure) herein, but only limited by the claims appended hereto.

What is claimed as new and desired to be protected by Letters Patent of the United States is:

1. A display card for holding an item, the card comprising:

a front layer and a back layer, with at least a portion of said layers joined together, wherein said front layer has a first graphic image printed thereon;

a product-receiving blister, having a flange disposed between said front layer and back layer; and an opening in said front layer to fit around at least part of said product-receiving blister, said opening created by complete separation of a cut-out portion from said front layer;

wherein said cut-out portion is placed behind said blister, adhered to said back layer, and in register with said opening in said front layer.

2. The display card of claim 1, wherein said cut-out portion contains a second graphic image that together with said first graphic image forms an overall image on said display card.

3. The display card of claim 2, wherein said first and second graphic images are printed simultaneously by the same process.

4. The display card of claim 1, wherein said cut-out portion is created by die cutting.

5. The display card of claim 1, wherein said cut-out portion is created by laser cutting.

6. The display card of claim 1, wherein at least a portion of said front layer or said back layer comprises a tear-resistant material.

7. A method for producing a display card for holding an item, the method comprising:

providing a front layer and a back layer;

printing a first graphic on said front layer;

creating a cut-out portion in said front layer, said cut-out portion containing a second graphic that is a subset of first graphic;

adhering said cut-out portion to said back layer in register with an opening created in the front layer by removal of said cut-out portion, while said cut-out portion is still at least partly attached to said front layer;

detaching said cut-out portion from said front layer placing a blister within said opening;

joining said front and back layers together to retain said blister; whereby after said joining step, said second graphic is in proper register with said first graphic.

8. The method of claim 7, wherein said front and back layer are formed from a single sheet of material and said sheet of material is folded to bring said front layer into proximity with said back layer.

9. The method of claim 7, wherein said front and back layer are separate sheets.

10. The method of claim 7, wherein at least a portion of said front layer or said back layer comprises a tear-resistant material.

11. A display card for holding an item, the card comprising:

a front layer and a back layer, with at least a portion of said layers joined together, wherein said front layer has a first graphic image printed thereon;

a product-receiving blister, having a flange disposed between said front layer and back layer; and an opening in said front layer to fit around at least part of said product-receiving blister, said opening created by complete removal of a cut-out portion from said front layer;

wherein said cut-out portion is placed behind said blister, adhered to said back layer, and in register with said opening in said front layer.

12. The method of claim 7, wherein said cut-out portion is punched or pressed from said front layer into contact with said back layer.

13. The method of claim 7, wherein said cut-out portion is pressed against said back layer by a heated platen.

* * * * *